US008695830B2

(12) United States Patent
Meyers et al.

(10) Patent No.: US 8,695,830 B2
(45) **Date of Patent: *Apr. 15, 2014**

(54) CONTAINER LID HAVING INDEPENDENTLY PIVOTING FLIP TOP AND HANDLE

(75) Inventors: David O. Meyers, Kaysville, UT (US); Steven M. Sorensen, Alpine, UT (US); Kim L. Sorensen, Alpine, UT (US)

(73) Assignee: Runway Blue, LLC, Pleasant Grove, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/610,445

(22) Filed: Sep. 11, 2012

(65) Prior Publication Data

US 2014/0069918 A1 Mar. 13, 2014

(51) Int. Cl.
*B65D 51/18* (2006.01)

(52) U.S. Cl.
USPC ..... 220/254.3; 220/845; 220/836; 220/814; 220/810; 215/306; 215/228; D9/449; D9/443

(58) Field of Classification Search
USPC ..... 220/212, 212.5, 254.3–254.5, 710.5, 220/752, 810, 836–837, 840–841, 845–846, 220/814; 215/228, 306; 222/566; D9/443, D9/449; 16/267, 365, 444–445
See application file for complete search history.

(56) References Cited

U.S. PATENT DOCUMENTS

| | | | | |
|---|---|---|---|---|
| 1,037,051 | A * | 8/1912 | Ramsey | 215/235 |
| 1,094,469 | A | 4/1914 | Pick | |
| 1,389,732 | A | 9/1921 | Baron | |
| 1,479,053 | A * | 1/1924 | Brooks | 220/263 |
| 1,573,620 | A | 2/1926 | Allston | |
| 2,056,879 | A | 10/1936 | Winterhalter et al. | |
| 2,272,867 | A | 2/1942 | Cobel | |
| 2,514,573 | A | 7/1950 | Harrison | |
| 2,573,378 | A | 10/1951 | Zurlinden | |
| 2,574,876 | A | 11/1951 | Lebus | |
| 2,575,299 | A | 11/1951 | Scheel | |
| 2,638,253 | A | 5/1953 | Mueller | |
| 2,748,997 | A | 6/1956 | Richmond, Sr. | |
| 2,752,971 | A | 7/1956 | Tupper | |
| 2,754,866 | A | 7/1956 | Coltman | |
| 3,022,925 | A * | 2/1962 | Daniell | 222/517 |

(Continued)

FOREIGN PATENT DOCUMENTS

| | | |
|---|---|---|
| CN | 201139196 | 10/2008 |
| JP | 2006103793 A | 4/2004 |
| JP | 2008247404 | 10/2008 |

OTHER PUBLICATIONS

U.S. Appl. No. 12/762,292, filed Apr. 16, 2010, Meyers, et al.

(Continued)

*Primary Examiner* — Mickey Yu
*Assistant Examiner* — Brijesh V. Patel
(74) *Attorney, Agent, or Firm* — Maschoff Brennan

(57) ABSTRACT

A container lid for sealing an opening to a container may include a handle and a flip top that are each independently pivotable along the same axis. The handle can be secured to the container lid between a mount on the lid and the flip top. The handle supports the weight of the container and, because the handle is independently rotatable relative to the flip top, the handle will not inadvertently open the flip top.

20 Claims, 4 Drawing Sheets

(56) References Cited

U.S. PATENT DOCUMENTS

| | | | | |
|---|---|---|---|---|
| 3,091,361 | A | 5/1963 | Gawron | |
| 3,143,205 | A | 8/1964 | Ruderian | |
| 3,144,016 | A | 8/1964 | Basci | |
| 3,168,226 | A | 2/1965 | Underwood | |
| 3,369,691 | A | 2/1968 | Wei | |
| 3,552,548 | A | 1/1971 | Wallestad et al. | |
| 3,770,160 | A * | 11/1973 | Flider | 220/318 |
| 3,820,692 | A * | 6/1974 | Swett et al. | 222/547 |
| D233,116 | S | 10/1974 | Swett et al. | |
| 4,022,352 | A | 5/1977 | Pehr | |
| 4,136,799 | A | 1/1979 | Albert | |
| 4,158,902 | A | 6/1979 | Chernack et al. | |
| D261,088 | S | 10/1981 | Akimov et al. | |
| 4,399,926 | A | 8/1983 | Eidels-Dubovoy | |
| 4,457,458 | A | 7/1984 | Heinol | |
| 4,474,303 | A | 10/1984 | Maccise | |
| 4,519,518 | A | 5/1985 | Wiles et al. | |
| 4,537,044 | A | 8/1985 | Putnam | |
| 4,735,333 | A | 4/1988 | Lay et al. | |
| 4,776,501 | A | 10/1988 | Ostrowsky | |
| 4,805,790 | A | 2/1989 | Leonetti et al. | |
| 4,932,225 | A | 6/1990 | Bighouse | |
| 5,065,877 | A * | 11/1991 | Karppinen et al. | 215/239 |
| 5,065,911 | A | 11/1991 | Rohr et al. | |
| 5,088,614 | A | 2/1992 | Dumestre | |
| D330,862 | S | 11/1992 | Shibley et al. | |
| 5,228,584 | A | 7/1993 | Williams, Jr. | |
| D342,898 | S | 1/1994 | Cane | |
| 5,289,930 | A * | 3/1994 | Inouye | 215/235 |
| D350,460 | S | 9/1994 | Picozza et al. | |
| 5,386,922 | A | 2/1995 | Jordan | |
| D356,499 | S | 3/1995 | Cautereels et al. | |
| 5,547,111 | A | 8/1996 | Geiger et al. | |
| 5,609,277 | A | 3/1997 | McDonald | |
| D382,968 | S | 8/1997 | Giles et al. | |
| D404,305 | S | 1/1999 | De Baschmakoff | |
| D405,654 | S | 2/1999 | Moran | |
| D421,547 | S | 3/2000 | Demers | |
| 6,161,713 | A | 12/2000 | Krich | |
| 6,283,333 | B1 | 9/2001 | Knickerbocker et al. | |
| 6,299,005 | B1 | 10/2001 | Higgins | |
| 6,379,032 | B1 | 4/2002 | Sorensen | |
| D458,081 | S | 6/2002 | Bodum | |
| D461,420 | S | 8/2002 | Kerman | |
| D497,431 | S | 10/2004 | Bentley | |
| 6,832,412 | B2 * | 12/2004 | Kim | 16/354 |
| 6,860,397 | B1 | 3/2005 | Walters, Jr. | |
| D504,273 | S | 4/2005 | Ancona | |
| D508,185 | S | 8/2005 | Gauss | |
| D510,235 | S * | 10/2005 | Sorensen | D7/510 |
| D518,336 | S | 4/2006 | Hirani | |
| 7,073,678 | B1 | 7/2006 | Dibdin et al. | |
| D526,827 | S | 8/2006 | Allen et al. | |
| D528,862 | S | 9/2006 | Li | |
| D529,339 | S | 10/2006 | Carreno et al. | |
| D532,650 | S | 11/2006 | de Groote | |
| D543,454 | S | 5/2007 | Leoncavallo et al. | |
| D546,131 | S | 7/2007 | Morales | |
| D547,607 | S | 7/2007 | Forsman | |
| D565,353 | S | 4/2008 | Roth et al. | |
| D574,190 | S | 8/2008 | Homma | |
| D580,227 | S * | 11/2008 | Roth et al. | D7/510 |
| D586,184 | S | 2/2009 | Miller et al. | |
| D587,069 | S | 2/2009 | Bodum | |
| D589,751 | S | 4/2009 | Liu et al. | |
| D592,913 | S | 5/2009 | Pinelli et al. | |
| 7,533,783 | B2 | 5/2009 | Choi et al. | |
| D593,811 | S | 6/2009 | Carreno | |
| D599,664 | S | 9/2009 | Fujinami et al. | |
| D604,103 | S | 11/2009 | Alviar et al. | |
| D609,970 | S | 2/2010 | Richau et al. | |
| D613,110 | S | 4/2010 | Lane et al. | |
| D622,089 | S | 8/2010 | Daniel et al. | |
| D622,554 | S | 8/2010 | Carreno | |
| 7,806,284 | B2 | 10/2010 | Mangano | |
| D626,837 | S | 11/2010 | Meyers et al. | |
| D626,838 | S | 11/2010 | Meyers et al. | |
| D628,483 | S | 12/2010 | McKinney et al. | |
| D629,657 | S | 12/2010 | Carreno | |
| 7,870,980 | B2 | 1/2011 | Wilson et al. | |
| D641,594 | S | 7/2011 | Huang | |
| D644,065 | S | 8/2011 | Llerena | |
| 8,020,257 | B2 | 9/2011 | Merten et al. | |
| D646,546 | S | 10/2011 | Robinson et al. | |
| D646,919 | S | 10/2011 | Nilsson | |
| D647,760 | S | 11/2011 | Pearson | |
| D652,256 | S | 1/2012 | Eyal | |
| D655,131 | S | 3/2012 | Nilsson | |
| D655,967 | S | 3/2012 | Bodum | |
| D656,357 | S | 3/2012 | Enghard | |
| D658,445 | S * | 5/2012 | Carreno | D7/510 |
| D661,551 | S | 6/2012 | Gilbert | |
| D666,047 | S | 8/2012 | Lin | |
| D666,061 | S | 8/2012 | Ying | |
| D667,694 | S | 9/2012 | Meyers et al. | |
| 8,302,796 | B1 | 11/2012 | Johnson | |
| 8,342,349 | B2 | 1/2013 | Lu | |
| D677,121 | S | 3/2013 | Meyers et al. | |
| D686,885 | S | 7/2013 | Meyers et al. | |
| D686,886 | S | 7/2013 | Meyers et al. | |
| D686,887 | S | 7/2013 | Meyers et al. | |
| D686,888 | S | 7/2013 | Meyers et al. | |
| 2002/0074334 | A1 | 6/2002 | Karp | |
| 2003/0085228 | A1 | 5/2003 | Oakes | |
| 2004/0217139 | A1 * | 11/2004 | Roth et al. | 224/148.7 |
| 2004/0262306 | A1 | 12/2004 | Smith | |
| 2005/0045634 | A1 * | 3/2005 | Ward et al. | 220/254.3 |
| 2005/0045636 | A1 | 3/2005 | Lown et al. | |
| 2007/0012693 | A1 | 1/2007 | Kummer | |
| 2007/0175931 | A1 | 8/2007 | Leoncavallo et al. | |
| 2008/0099514 | A1 | 5/2008 | Carter et al. | |
| 2009/0178940 | A1 | 7/2009 | Said | |
| 2009/0188884 | A1 | 7/2009 | Nelson et al. | |
| 2009/0188933 | A1 | 7/2009 | Daams | |
| 2009/0301990 | A1 | 12/2009 | Cresswell et al. | |
| 2010/0187235 | A1 | 7/2010 | Chen | |
| 2010/0200438 | A1 | 8/2010 | Davies | |
| 2010/0206835 | A1 | 8/2010 | Yu | |
| 2010/0224631 | A1 * | 9/2010 | Roth et al. | 220/288 |
| 2010/0282703 | A1 * | 11/2010 | Yang | 215/228 |
| 2011/0017760 | A1 * | 1/2011 | Newman | 220/836 |
| 2011/0083300 | A1 | 4/2011 | Heger et al. | |
| 2011/0253733 | A1 * | 10/2011 | Meyers et al. | 220/833 |

OTHER PUBLICATIONS

U.S. Appl. No. 13/232,891, filed Sep. 14, 2011, Meyers, et al.
U.S. Appl. No. 13/232,935, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/609,238, filed Sep. 10, 2012, Meyers, et al.
U.S. Appl. No. 13/633,864, filed Oct. 2, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.
U.S. Appl. No. 61/832,085, filed Jun. 6, 2013, Sorensen, et al.
Kor One, http://www.korwater.com/buyONE, accessed Apr. 21, 2010.
Core 77, http://www.core77.com/blog/materials/kor.sub.--one.sub.--water.su- b.--vessel.sub.--actual.sub.--size.sub.--10211.asp, accessed Apr. 21, 2010.
Koyono, http://www.koyono.com/KOR-ONE-Green-Zen-Water-Hydration-Vessel.sub- .--p/kor-one.htm, accessed Apr. 21, 2010.
Fit Sugar, www.fitsugar.com/2496788, accessed Apr. 21, 2010.
Thermos, http://www.shopthermos.com/detail/TMS+HP4000GR6, accessed Apr. 21, 2010.
Goodlifter, http://www.goodlifer.com/2009/02/360-paper-water-bottle/, accessed Apr. 21, 2010.
Notice of Allowance from U.S. Appl. No. 29/430,882 dated Aug. 5, 2013.
Advisory Action from U.S. Appl. No. 12/762,292 dated May 24, 2013.
Office Action from U.S. Appl. No. 12/762,292 dated Jul. 1, 2013.

(56) References Cited

OTHER PUBLICATIONS

Office Action from U.S. Appl. No. 12/762,292 dated Oct. 2, 2012.
Office Action from U.S. Appl. No. 12/762,292 dated Jul. 17, 2012.
Office Action from U.S. Appl. No. 12/762,292 dated Feb. 10, 2012.
Notice of Allowance from U.S. Appl. No. 29/431,544 dated Aug. 14, 2013.
Office Action from U.S. Appl. No. 29/431,544 dated Mar. 25, 2013.
Office Action from U.S. Appl. No. 13/232,891 dated Jul. 19, 2013.
Office Action from U.S. Appl. No. 13/609,238 dated May 30, 2013.
International Search Report from PCT Application No. PCT/US2011/026508 dated Sep. 29, 2011.
Written Opinion from PCT Application No. PCT/US2011/026508 dated Sep. 29, 2011.
International Preliminary Report on Patentability from PCT Application No. PCT/US2011/026508 dated Oct. 16, 2012.
International Search Report from PCT Application No. PCT/US2012/054483 dated Nov. 16, 2012.
International Search Report and Written Opinion from PCT Application No. PCT/US2012/054497 dated Nov. 20, 2012.
International Search Report and Written Opinion from PCT Application No. PCT/US2013/052132 dated Aug. 16, 2013.
International Search Report and Written Opinion from PCT Application No. PCT/US2013/047161 dated Nov. 20, 2013.

* cited by examiner

CONTAINER LID HAVING INDEPENDENTLY PIVOTING FLIP TOP AND HANDLE

CROSS-REFERENCE TO RELATED APPLICATIONS

Not Applicable.

BACKGROUND

Many containers such as bottles include lids having integrated handles. Some containers can also employ a flip top to facilitate quick access to the contents of the container. When including a handle on such lids, there is a trade-off between positioning the handle in a convenient and efficient location, and minimizing the risk that the flip top will be opened unintentionally due to forces on the handle.

BRIEF SUMMARY

The present invention is directed to a container lid that includes a handle and a flip top that are each independently pivotable along the same axis. In this manner, the container lid increases the efficiency of using a container to carry, store, or consume contents.

In one embodiment, a lid for a container comprises a lid base having an opening for dispensing contents of the container, and a mount. The lid also comprises a handle, and a flip top for sealing the opening. The flip top includes a flip top pivot that is positioned between the handle when the handle is inserted into the mount. The handle and the flip top are each independently pivotable within the mount.

In another embodiment, a container comprises a bottle and a lid for sealing an opening of the bottle. The lid comprises a lid base having an opening for dispensing contents of the bottle, and a mount. The lid further comprises a handle, and a flip top for sealing the opening. The flip top includes a flip top pivot that is positioned between the handle when the handle is inserted into the mount. The handle and the flip top each are independently pivotable within the mount.

In another embodiment, a container comprises a bottle, and a lid that connects to the top of the bottle to seal the bottle. The lid comprises a lid base that includes an opening for dispensing contents of the bottle, and a mount that secures a handle and a flip top to the lid base. The handle includes a handle pivot on both sides which insert into openings on posts of the mount, and the flip top includes a flip top pivot having a protrusion on both sides that insert into openings on each side of the handle to secure the handle between the flip top and the mount. The flip top remains independently pivotable within the openings in the handle, and the handle remains independently pivotable within the openings in the posts.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is directed to a container lid that includes a handle and a flip top that are each independently pivotable along the same axis. In this manner, the container lid increases the efficiency of using a container to carry, store, or consume contents.

In one embodiment, a lid for a container comprises a lid base having an opening for dispensing contents of the container, and a mount. The lid also comprises a handle, and a flip top for sealing the opening. The flip top includes a flip top pivot that is positioned between the handle when the handle is inserted into the mount. The handle and the flip top are each independently pivotable within the mount.

In another embodiment, a container comprises a bottle and a lid for sealing an opening of the bottle. The lid comprises a lid base having an opening for dispensing contents of the bottle, and a mount. The lid further comprises a handle, and a flip top for sealing the opening. The flip top includes a flip top pivot that is positioned between the handle when the handle is inserted into the mount. The handle and the flip top each are independently pivotable within the mount.

In another embodiment, a container comprises a bottle, and a lid that connects to the top of the bottle to seal the bottle. The lid comprises a lid base that includes an opening for dispensing contents of the bottle, and a mount that secures a handle and a flip top to the lid base. The handle includes a handle pivot on both sides which insert into openings on posts of the mount, and the flip top includes a flip top pivot having a protrusion on both sides that insert into openings on each side of the handle to secure the handle between the flip top and the mount. The flip top remains independently pivotable within the openings in the handle, and the handle remains independently pivotable within the openings in the posts.

Figure 1:
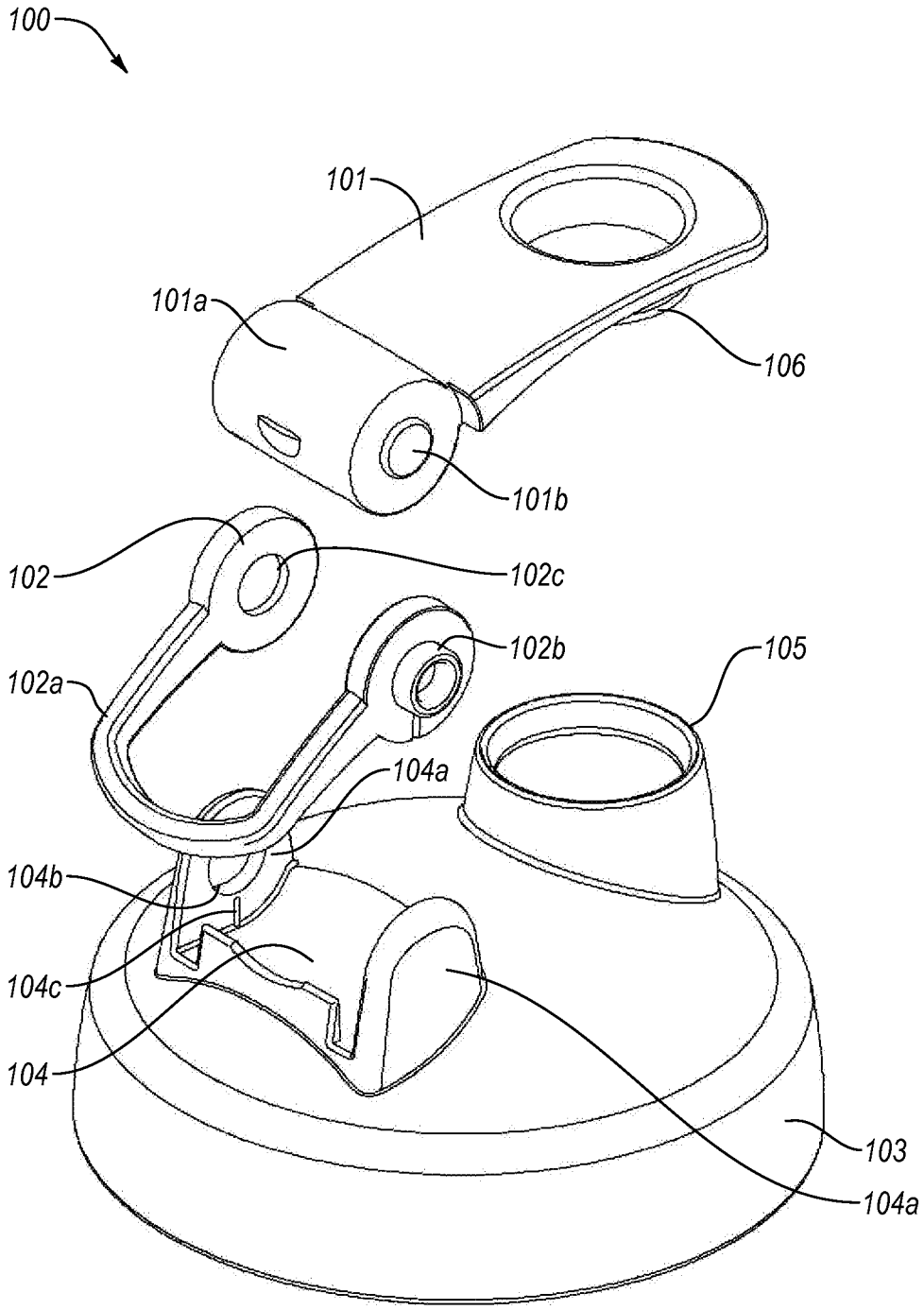
FIG. 1 illustrates an exploded view of an exemplary container lid according to one or more embodiments of the present invention.
Figure 2:
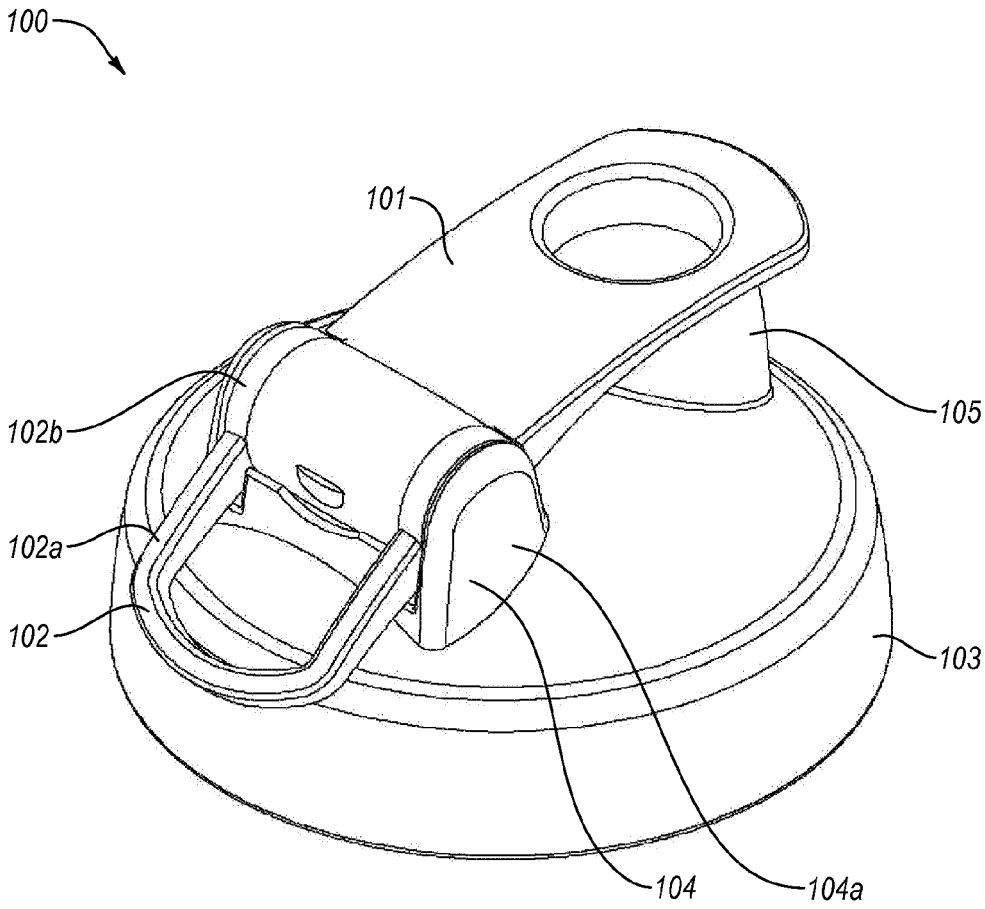
FIG. 2 illustrates the assembled container lid of FIG. 1.

FIG. 1 illustrates an exploded view of an exemplary container lid 100 according to one or more embodiments of the invention. Lid 100 comprises a base 103 having a spout (or opening) 105 and a mount 104. A pivoting handle 102 and flip top 101 connect to mount 104 as is shown in FIG. 2.

Lid 100 can be attached to a container such as a bottle to seal the container. Although the Figures illustrate that spout 105 is sealed by pressing the protrusion 106 of flip top 101 into spout 105, other means of sealing a spout or opening in the lid using a flip top can equally be employed (e.g., a flip top that extends around a spout, a flip top that clips to base 103, etc.).

Flip top 101 includes a flip top pivot 101*a* having a protrusion 101*b* on each side. As shown in FIGS. 1, 2, 4 and 5, flip top pivot 101*a* may comprise an at least substantially solid or continuous body and protrusions 101*b* may extend outwardly from each side or end of the body. Handle 102 includes a loop 102*a* and a handle pivot 102*b* on each side. Flip top 101 and handle 102 are mounted within mount 104 such that flip top 101 and handle 102 can each independently pivot. Although the Figures illustrate a handle having a round loop, loops of other shapes could also be used. Further, handle 102 can also be formed in a shape other than a loop as long as the handle includes handle pivots 102*b* on both sides (e.g., a hook, a clip, etc.).

As shown in FIG. 1, mount 104 includes posts 104*a* positioned on opposite sides of the mount. Each of posts 104*a* includes an opening 104*b* (only visible on one side) for receiving a corresponding handle pivot 102*b*.

As shown in FIG. 2, handle 102 is attached to mount 104 by inserting handle pivots 102*b* into openings 104*b* or receiving portions in posts 104*a* of mount 104. With handle 102 attached to mount 104, flip top pivot 101*a* can be inserted between handle 102 such that protrusions 101*b* insert into openings 102*c* or receiving portions in handle 102.

In this manner, flip top 101 and handle 102 are securely attached to the lid while enabling flip top 101 and handle 102 to remain independently pivotable. For example, while flip top 101 remains inserted into spout 105, handle 102 can be freely pivoted around the axis of mount 104. Similarly, flip top 101 can be pivoted around the axis of mount 104 without pivoting handle 102.

Figure 3:
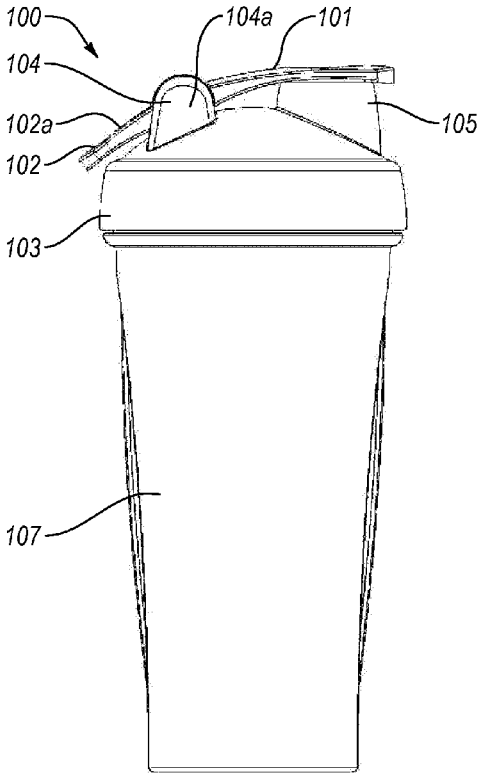
FIGS. 3-4 illustrate the container lid of FIG. 1 when attached to a bottle.
Figure 4:
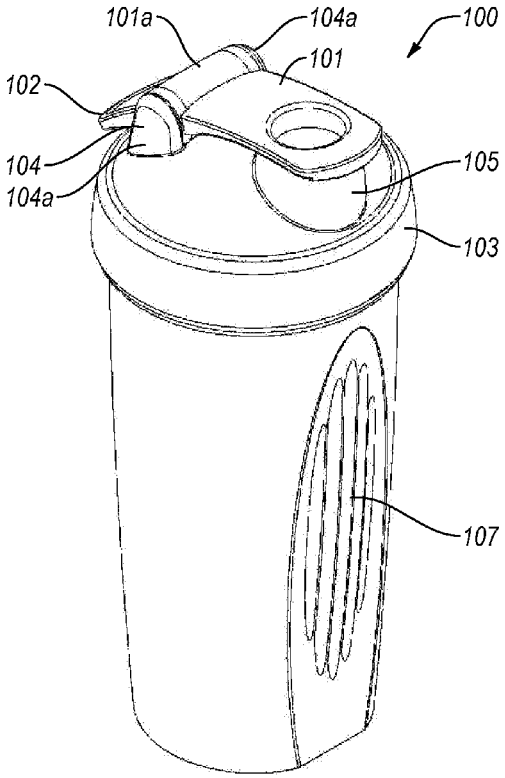

This configuration facilitates the storage and handling of a container having lid 100. FIGS. 3 and 4 illustrate an exemplary bottle 107 on which lid 100 can be used. Such bottles 107 can be used to store, carry, and/or mix ingredients of a beverage or other food product. The position of handle 102 facilitates carrying a container while minimizing the likelihood that flip top 101 will separate from spout 105 inadvertently. Also, because handle 102 can be pivoted independently from flip top 101, use of a container is further facilitated.

Figure 5:
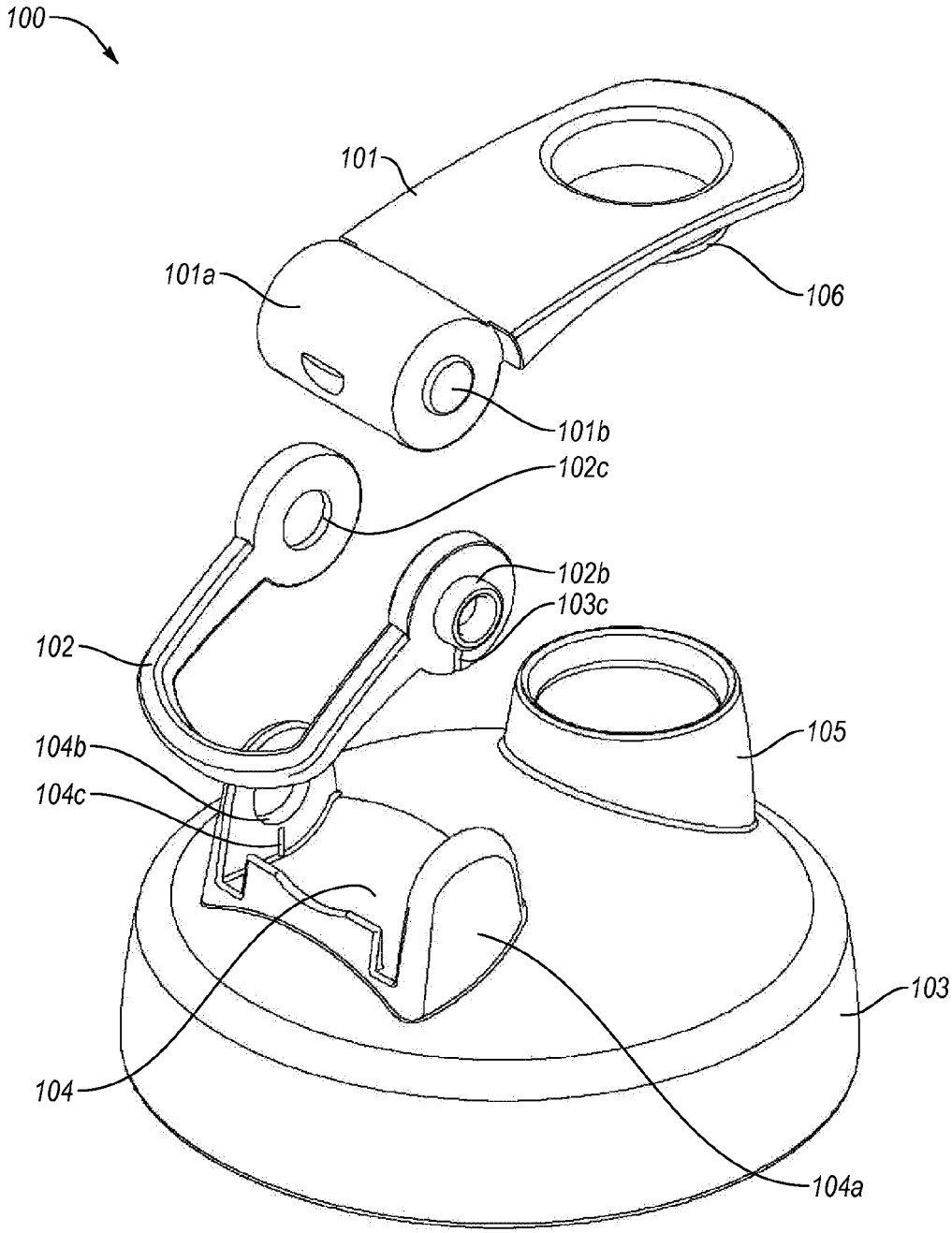
FIG. 5 illustrates a locking slot for maintaining the position of the handle of the container lid of FIG. 1.

In some embodiments, such as is shown in FIG. 5, handle 102 can include grooves 103*c* that interlock with corresponding rails 104*c* in mount 104. When handle 102 is pivoted downward to the orientation shown in FIG. 2, rails 104*c* are positioned within grooves 103*c* thereby holding handle 102 in the orientation. Maintaining the position of handle 102 can be desirable in many situations such as when drinking a beverage through spout 105. Of course, more than one set of rails and grooves could be configured on handle 102 and mount 104 to provide more than one locking position for handle 102.

As stated above, lid 100 can be assembled by first inserting handle pivots 102*b* into openings 104*b* in mount 104. Handle 102 can be manufactured from materials that are sufficiently flexible to allow handle pivots 102*b* to be inserted into openings 104*b* (e.g. by squeezing handle pivots 102*b* together). Because handle 102 can be squeezed together, handle pivots 102*b* can therefore have a substantial length for insertion into openings 104*b*.

To retain handle pivots 102*b* within openings 104*b* in posts 104*a* of mount 104, flip top pivot 101*a* is then pressed into handle 102 to insert protrusions 101*b* within openings 102*c* in handle 102. In this way, handle 102 is secured between flip top pivot 101*a* and posts 104*a* (i.e., flip top pivot 101*a* prevents handle 102 from being squeezed together) to allow handle 102 to support the weight of a container on which lid 100 is used.

Lid 100 can be manufactured from materials that are sufficiently flexible to allow posts 104*a* to deflect slightly when flip top pivot 101*a* is inserted, but sufficiently rigid to prevent handle 102 and flip top 101 from being removed from mount 104 without significant force.

In other words, while flip top pivot 101*a* is inserted between handle 102, handle 102 cannot be squeezed sufficiently to remove handle pivots 102*b* from openings 104*b*. Further, mount 104 can be sufficiently rigid such that flip top 101 cannot be removed without great force, thereby preventing the inadvertent removal of handle 102 even when substantial force is applied to handle 102 (e.g. when handle 102 supports a full container during rugged activities). In this manner, flip top 101, handle 102, and lid base 103 can be manufactured as separate components and easily assembled, thus simplifying the manufacture of lids 100.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A lid for a container comprising:

a lid base having an opening for dispensing contents of the container;

a mount comprising a first post and a second post;

a handle comprising a first end with a first handle pivot and a second end with a second handle pivot; and a flip top for sealing the opening, the flip top comprising an elongated body with a first end for opening the flip top and a second end including a flip top pivot, wherein:

the flip top pivot is disposed between and engages the first end of the handle and the second end of the handle, the first handle pivot is connected to a first receiving portion of the first post of the mount, the first handle pivot comprising a first protrusion that extends into the first receiving portion of the first post of the mount, the second handle pivot is connected to a second receiving portion of the second post of the mount, the second handle pivot comprising a second protrusion that extends into the second receiving portion of the second post of the mount, the first end of the handle is sandwiched between a first end of the flip top pivot and the first post of the mount and the second end of the handle is sandwiched between a second end of the flip top pivot and the second post of the mount, a first protrusion on the first end of the flip top pivot extends into a first opening in the first end of the handle and a second protrusion on the second end of the flip top pivot extends into a second opening in the second end of the handle, the handle and the flip top are each independently pivotable relative to the lid, and the handle and the flip top are each independently movable about a common axis.

2. The lid of claim 1, wherein the first and second protrusions of the first and second handle pivots comprise cylindrical protrusions that extend in opposite directions.

3. The lid of claim 1, wherein the first protrusion on the first end of the flip top pivot is inserted into the first opening in the first end of the handle and the second protrusion on the second end of the flip top pivot is inserted into the second opening in the second end of the handle.

4. The lid of claim 3, wherein the first and second ends of the handle deflect inwardly to allow the first and second protrusions of the first and second handle pivots to be inserted into the first and second receiving portions in the first and second posts of the mount.

5. The lid of claim 1, wherein the handle comprises a loop, the first opening in the first end of the handle and the second opening in the second end of the handle comprise circular openings, and the first and second protrusions on the first and second ends of the flip top pivot comprise coaxial cylindrical protrusions that extend from the flip top pivot in opposite directions.

6. The lid of claim 1, wherein the handle is pivotable around an axis of the mount; and wherein the flip top is pivotable around the axis of the mount.

7. The lid of claim 1, wherein the flip top pivot comprises an at least substantially solid body and prevents the first and second ends of the handle from being squeezed together.

8. The lid of claim 1, wherein the mount includes at least one rail over which a groove in the handle is positioned to hold the handle in a particular orientation relative to the mount.

9. The lid of claim 8, wherein the at least one rail includes a first rail on an inside of the first post; and wherein the groove is positioned on a surface of the first end of the handle that faces the inside of the first post.

10. The lid of claim 8, wherein the at least one rail includes multiple rails on an inside of the first post; and wherein the handle includes multiple grooves positioned on a surface of the first end of the handle that faces the inside of the first post.

11. The lid of claim 1, wherein the opening in the lid base is a spout into which a downwardly extending protrusion of the flip top is inserted to seal the opening.

12. A container comprising:

a bottle; and a lid for sealing an opening of the bottle, the lid comprising:

a lid base having an opening for dispensing contents of the bottle;

a handle comprising a first end with a first handle pivot and a second end with a second handle pivot; and a flip top for sealing the opening in the lid base, the flip top including a flip top pivot comprising:

a first protrusion that is disposed in a first receiving portion of the first end of the handle; and a second protrusion that is disposed in a second receiving portion of the second end of the handle, wherein the first and second protrusions extend from the flip top pivot away from each other; and a mount connecting the handle and the flip top to the lid base, the mount comprising:

a first post including a first receiving portion, the first handle pivot disposed in the first receiving portion of the first post; and a second post including a second receiving portion, the second handle pivot disposed in the second receiving portion of the second post;

wherein the handle and the flip top are each independently pivotable within the mount.

13. The container of claim 12, wherein the flip top pivot comprises an at least substantially solid structure that prevents the first and second ends of the handle from being squeezed together.

14. The container of claim 12, wherein the handle supports a weight of the container and allows the container to be carried without creating an opening force on the flip top.

15. The container of claim 14, wherein the first and second ends of the handle deflect inwardly to allow the first and second handle pivots to be inserted into the first and second receiving portions in the first and second posts of the mount.

16. The container of claim 12, wherein the handle comprises a loop.

17. The container of claim 12, wherein the handle is pivotable about an axis of the mount; and wherein the flip top is pivotable about the same axis of the mount.

18. The container of claim 17, wherein the flip top pivot comprises a substantially solid body with the first protrusion on a first end of the body and the second protrusion on a second end of the body.

19. The container of claim 12, wherein the first post of the mount includes at least one rail and the first end of the handle includes at least one groove.

20. A container comprising:

a bottle; and a lid that connects to a top of the bottle to seal the bottle, the lid comprising:

a lid base comprising an opening for dispensing contents of the bottle and a mount that secures a handle and a flip top to the lid base;

the mount comprising:

a first post; and a second post;

the handle comprising:

a loop;

a first handle pivot at a first end of the loop, the first handle pivot connected to the first post of the mount and disposed between the first and second posts of the mount; and a second handle pivot at a second end of the loop, the second handle pivot connected to the second post of the mount and disposed between the first and second posts of the mount; and the flip top comprising:

an elongated body with a first end for opening the flip top and a second end with a flip top pivot, the flip top pivot comprising a substantially solid structure with a first end and a second end;

a first protrusion extending outwardly from the first end of the flip top pivot, the first protrusion disposed in a receiving portion of the first handle pivot; and a second protrusion extending outwardly from the second end of the flip top pivot, the second protrusion disposed in a receiving portion of the second handle pivot;

wherein the flip top pivot is disposed between the first and second handle pivots of the handle;

wherein the flip top is independently pivotable relative to the handle; and wherein the handle is independently pivotable relative to the flip top.

* * * * *